US006962025B1

(12) United States Patent
Hill

(10) Patent No.: US 6,962,025 B1
(45) Date of Patent: Nov. 8, 2005

(54) METAL PLASMA SURFACE-MODIFIED THERMAL BARRIER CHANNEL

(75) Inventor: Nathanael Hill, Columbia Heights, MN (US)

(73) Assignee: H.B. Fuller Licensing & Financing, Inc., St. Paul, MN (US)

( * ) Notice: Subject to any disclaimer, the term of this patent is extended or adjusted under 35 U.S.C. 154(b) by 511 days.

(21) Appl. No.: 09/867,046

(22) Filed: May 29, 2001

(51) Int. Cl.[7] ..... E04B 1/68; E04F 15/14

(52) U.S. Cl. ..... 52/396.04; 52/461; 52/741.4; 52/745.16; 148/525; 148/900; 427/535

(58) Field of Search ..... 52/1, 395, 396.01, 52/396.04, 204.5, DIG. 5, 745.15, 745.16, 204.53, 741.3, 741.4; 49/DIG. 1

(56) References Cited

U.S. PATENT DOCUMENTS

| | | | | |
|---|---|---|---|---|
| 4,057,944 A | | 11/1977 | Wyatt, Jr. et al. | |
| 4,675,205 A | | 6/1987 | Boncoeur et al. | |
| 4,982,067 A | | 1/1991 | Marantz et al. | |
| 5,332,625 A | | 7/1994 | Dunn et al. | |
| 5,389,195 A | | 2/1995 | Ouderkirk et al. | |
| 5,830,376 A | | 11/1998 | Bohylke et al. | |
| 6,035,101 A | | 3/2000 | Sajoto et al. | |
| 6,035,596 A | * | 3/2000 | Brunnhofer | 52/404.1 |
| 6,271,592 B1 | * | 8/2001 | Kim et al. | 257/751 |
| 6,387,800 B1 | * | 5/2002 | Liu et al. | 438/653 |
| 6,403,465 B1 | * | 6/2002 | Liu et al. | 438/627 |

OTHER PUBLICATIONS

Herman, H., "Plasma–sprayed Coatings," *Scientific American*, pp. 112–117 (Sep., 1988).

Pike, et al., "Plasma–Sprayed Coatings As Adherend Surface Pretreatments," *Int. J. Adhesion and Adhesives*, vol. 12, No. 4, Oct. 1992 (pp. 227–231).

"On the Surface," vol. I–IV, product literature from Metro-Line Industries, Inc. (4 pages).

* cited by examiner

*Primary Examiner*—Carl D. Friedman
*Assistant Examiner*—Yvonne M. Horton

(57) ABSTRACT

A method of modifying a thermal barrier assembly that includes a channel, the method including exposing a surface of a channel to a plasma that includes metal moieties and depositing the metal moieties on the surface of the channel.

47 Claims, 1 Drawing Sheet

METAL PLASMA SURFACE-MODIFIED THERMAL BARRIER CHANNEL

BACKGROUND OF THE INVENTION

The invention relates to surface-modifying a thermal barrier assembly.

Metal exterior window and door casings, which are often made of aluminum, are widely used in a variety of structures including office and industrial buildings. Such metal casings are good thermal conductors and therefore can cause considerable heat loss in winter and heat gain in summer in buildings in which they are installed. To reduce this problem it is common to employ a "thermal barrier" between the interior and the exterior portions of a metal casing. The thermal barrier often includes a material of relatively low thermal conductivity, which serves to interrupt the transfer of thermal energy between the interior and exterior metal portions.

Thermal barriers often consist of a channel defined by two structural components, e.g., metal segments and an adhesive composition disposed in the channel.

Thermal barriers, when part of a structure such as a building, are often subjected to high stresses caused by day, night and seasonal thermal cycling of the metal segments, which have much lower thermal expansion coefficients than the composition disposed in the channel of the thermal barrier. These stresses are different on each side of the thermal barrier due to the differential between the interior and exterior temperatures. Consequently, the adhesive composition may bond from the metal segments of the thermal barrier resulting in a loss of structural integrity, which can lead to gaps and water infiltration in the thermal barrier assembly.

Attempts to increase the adhesion of the adhesive composition to the interior channel surface includes mechanically roughening the surface of the channel using methods such as abrading, scratching, lancing, sand blasting and scraping. Often the aesthetics of the assembly are sacrificed during these processes. In addition, these mechanical roughening techniques normally are conducted in a separate, off-line operation. Other methods that have been used in an effort to increase adhesion include chemical treatments such as solvent bonding and chemical etching.

SUMMARY

The invention features a method of modifying a thermal barrier assembly that includes a channel, the method including exposing a surface of the channel to a plasma comprising metal moieties and depositing the metal moieties on the surface of the channel. In one embodiment, the channel includes a surface treatment prior to the depositing step, the method further including removing at least a portion of the surface treatment from the channel.

In some embodiments, the metal is selected from the group consisting of aluminum, nickel, chromium, iron, graphite, molybdenum, copper, cobalt, tungsten, indium, manganese, zirconium, zinc, cesium, yttrium, antimony, and oxides, carbides, nitrides and suicides thereof, and alloys and mixtures thereof.

In other embodiments, the thermal barrier assembly includes a structure selected from the group consisting of a window casing, door casing and curtain wall.

In one embodiment, depositing includes forming a metal coating on the surface of the channel. In some embodiments, the coating has a thickness of no greater than about 2 mm.

In other embodiments, the channel is defined by a substrate that includes metal. In one embodiment the metal is aluminum. In some embodiments channel is defined by a substrate that includes a polymer.

In some embodiments the channel includes a first side wall, a second side wall positioned parallel to the first side wall and spaced no greater than about 2.5 cm from the first side wall. In another embodiment the thermal barrier assembly includes a window casing. In other embodiments the thermal barrier assembly includes a door casing.

In another aspect, the invention features a thermal barrier assembly that includes a channel comprising a layer of metal bonded to a surface the channel, the metal having been deposited onto the channel surface from a plasma.

In one embodiment, the thermal barrier assembly further includes an adhesive composition bonded to the modified surface of the channel. In other embodiments, the adhesive composition includes polyurethane. In another embodiment, the adhesive composition exhibits no greater than 5% shrinkage when bonded to the surface and subjected to the % Shrinkage Test Method. In some embodiments, the adhesive composition exhibits no greater than 1% shrinkage when bonded to the surface and subjected to the % Shrinkage Test Method. In other embodiments, the adhesive composition exhibits a shear strength of at least 2500 psi at room temperature after being subjected to the Thermal Cycling Method. In one embodiment, the adhesive composition exhibits a shear strength of at least 3000 psi at room temperature after being subjected to the Thermal Cycling Method. In another embodiment, the adhesive composition exhibits a shear strength of at least 7500 psi at room temperature after being subjected to the Thermal Cycling Method.

In one embodiment, the metal is selected from the group consisting of aluminum, nickel, chromium, iron, graphite, molybdenum, copper, cobalt, tungsten, indium, manganese, zirconium, zinc, cesium, yttrium, antimony, and oxides, carbides, nitrides and suicides thereof, and alloys and mixtures thereof.

In some embodiments, the channel is defined by a substrate that includes metal. In another embodiment, the metal includes aluminum. In other embodiments, the channel is defined by a substrate that includes a polymer.

In other aspects, the invention features a window casing that includes an above-described thermal barrier assembly. In another aspect, the invention features a door casing that includes an above-described thermal barrier assembly.

In other aspect, the invention features a process for making a thermal barrier assembly, the process includes exposing a surface of a channel of a thermal barrier assembly to a plasma comprising metal moieties and depositing the metal moieties on the surface of the channel. In some embodiments, the process further includes contacting the metal surface of the channel with an adhesive composition. In one embodiment, prior to the depositing, the channel includes a surface treatment disposed on the channel surface, the process further includes removing at least a portion of the surface treatment prior to depositing the metal moieties.

In some embodiments, the adhesive composition includes polyurethane.

In other embodiments, the surface treatment is selected from the group consisting of polyester, melamine, mill finish, conversion coating, primer, paint, acrylic, polyester, enamel, polyurethane, fluoropolymer, anodic finishes and combinations thereof.

In one embodiment, the process includes making a window casing. In other embodiments, the process includes making a door casing.

The invention provides a thermal barrier assembly that exhibits enhanced structural integrity with good tensile strength, improved shear strength, retention of shear strength after thermal cycling and reduced dry shrinkage, i.e., polymer creep, after repeated temperature cycling relative to the untreated thermal barrier. The thermal barrier assembly includes a surface-modified channel to which the thermal barrier composition of the assembly maintains good adhesion, and in which the thermal barrier composition exhibits low shrinkage over repeated thermal cycling relative to the same thermal barrier assembly without a surface-modified channel. The thermal barrier composition also exhibits good resistance to debonding from the surface-modified channel.

The invention also features a surface-modifying process that can be performed "inline," i.e., the surface modification can be performed during the thermal barrier manufacturing process, which can streamline the thermalbarrier manufacturing process. The invention provides a relatively narrow, focused plasma that is capable of modifying the target surface (e.g., depositing metal moieties directly on the target surface), with little to no modification (e.g., metal deposition) occurring on surfaces other than the target surface (e.g., areas where it is important to maintain the existing aesthetics of the assembly).

Other features of the invention will be apparent from the following description of the preferred embodiments thereof, and from the claims.

DETAILED DESCRIPTION OF THE PREFERRED EMBODIMENTS

Figure 1:
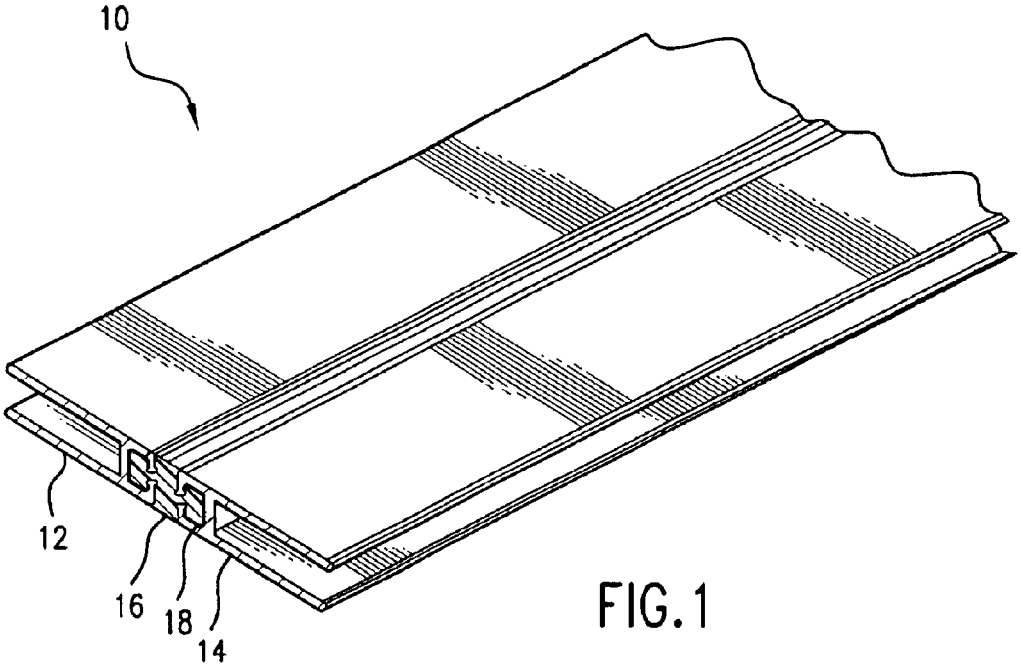
FIG. 1 shows a perspective view of a thermal barrier assembly for a window casing.

The method of modifying the surface a channel of a thermal barrier assembly includes exposing the surface of the channel to a plasma that includes metal moieties and depositing the metal moieties on the channel surface. As the metal moieties deposit on the surface of the channel they form a metal coating. When the molten metal moieties from the plasma contact the surface of the channel they modify the surface by burning and welding to the channel surface. As additional metal deposits on the surface of the channel it forms metal structures including, e.g., peaks, loops, valleys and voids and combinations thereof, on the surface of the channel, which increases the surface area of the channel relative to the unmodified channel. The increase in channel surface area provides additional potential points of contact for a subsequently applied thermal barrier composition. The metal structures on the modified channel surface also provide a mechanical mechanism for retaining the thermal barrier composition in place on the channel and inhibiting the thermal barrier composition from shrinking after cure. Without wishing to be bound by theory, the inventor believes that the thermal barrier composition surrounds the metal structures of the surface modification, which assists in maintaining the cured composition in position in the channel.

Preferably the metal moieties are deposited on the channel in an amount sufficient to modify the surface characteristics of the channel and to improve the adhesion of a later applied adhesive composition. The metal coating preferably covers at least about 10%, more preferably from about 50% to about 100% of the channel surface. The metal coating is also preferably sufficiently thin such that it remains bonded to the substrate, i.e., does not exhibit adhesive failure at the channel surface interface. Preferably the deposited metal coating is of a thickness of from about 0.35 mm to about 2.00 mm, more preferably from about 0.50 mm to about 0.80 mm.

The properties of the plasma, as well as the amount of time during which the channel is exposed to the plasma will affect the rate at which metal is deposited on the channel surface as well as the thickness of the deposited metal coating. In an in line process, the channel will move past the plasma at a rate sufficient to apply a coating having a predetermined thickness.

The plasma used to deposit the metal coating is generated by an electric arc plasma source or gas plasma discharge source. The plasma can be generated using several different sources depending upon the desired application. Useful sources include electric arc guns having various configurations. In one configuration the gun includes a square body having a conical extension. An air cap is fixed to the conical extension. The electrodes direct the wires of the gun together. The air cap has an orifice dimensioned to direct the plasma spray into a controlled discharge pattern at a predetermined diameter.

The plasma of the electric arc gun is generated by charging the wires of the arc gun to a temperature sufficient to achieve a molten metal plasma. An air jet passes through the electric arc gun and directs the molten metal plasma through the orifice of a focusing lens located on the cylindrical cap. The focusing lens focuses the spray of molten metal to a fine, high pressure point. The continuous high-pressure surge of the airjet blasts into the molten metal plasma, which is at a temperature of approximately 3000° C., and directs the molten metal onto the target substrate, i.e., the channel surface. Useful electric arc guns are commercially available under the trade designation TB2000 Arc (Sulzer-Metco Inc., Westbury, N.Y.).

Preferably the current passing through the wires of the plasma arc gun is from about 50 amps to about 400 amps, the voltage applied to the gun is from about 10 volts AC to about 75 volts AC and the pressure of the air traveling through the arc gun is from about 10 psi to about 100 psi.

The electric arc gun is constructed such that the dimension of the plasma spray at a point approximately two inches from the orifice of the arc gun is preferably sufficiently narrow to focus the plasma in a target channel of a thermal barrier assembly. Preferably the electric arc gun is constructed to avoid depositing metal in unwanted areas on the thermal barrier assembly, more preferably the spray if no greater than about 2 cm wide at the channel surface.

Various metals can be deposited on the surface of the channel including, e.g., aluminum, nickel, steel, zinc, chromium, iron, graphite, molybdenum, copper, cobalt, tungsten, indium, manganese, zirconium, cesium, yttrium, antimony, bronzes, and oxides, carbides, nitrides and suicides thereof, and alloys and mixtures thereof.

The structural components of the thermal barrier assembly can be made from a variety of materials including, e.g., metal, e.g., aluminum, and polymers including, e.g., plastic, polyvinyl chloride, filled or partially filled structural composites and fiberglass reinforced plastics including, e.g., unsaturated polyesters and epoxies.

The thermal barrier assembly can also include a surface treatment including, e.g., mill finish, conversion coating, primer, paint, organic paint compositions including, e.g., acrylic, polyester, enamel, polyurethane and fluoropolymer, anodic finishes including, e.g., clear, integral color and electrolytically deposited color, anodic finishes resulting from sealing processes including, e.g., boiling water seal, nickel acetate sealing additives and anti-smut additives. Commercial classes of finishes are described, e.g., in the American Architectural Manufacturers Association (AAMA) thermal Break TIR-A8-90 manual, section 4.1.2 entitled, "Cavity Surface Treatment."

The thermal barrier assembly is useful in a variety of constructions including, e.g., metal casing structures for windows, doorframes and curtain walls.

Preferably the surface of the thermal barrier is modified such that an adhesive composition disposed in the channel of the thermal barrier exhibits less than 5% shrinkage, more preferably less than 1% shrinkage, and a shear strength of at least 2500 psi, more preferably at least 3000 psi, most preferably at least 7500 psi. A variety of adhesive compositions are suitable for use as the barrier composition in the thermal barrier assembly including, e.g., polyurethanes, epoxies, epoxy-urethane hybrids, oxazolidones, isocyanurates, acrylics and combinations thereof.

Examples of useful polyurethane compositions include two-part formulations where one part includes glycols, polyols or a combination thereof and the other part includes polyisocyanate. Examples of useful polyols include those polyols having backbones of polyether, polyester and combinations thereof, and molecular weights in the range of about 62 to about 7000. Preferably the polyol is present in the composition in an amount sufficient to provide effective crosslinking of the composition, more preferably the polyol mixture includes an average of from about 2.0 to about 4.0 hydroxyl groups per molecule.

The polyisocyanate component of the formulation is preferably a polymer extended multi-isocyanate providing an average of from about 2 to about 3 isocyanate groups per molecule. Useful polyisocyanates are available under the trade designations Papi 2027 from Dow Chemical (Midland, Mich.) and Mondur MR from Bayer (Pittsburgh, Pa.), and Rubinate-M from Huntsman-ICI (West Deptford, N.J.). Non-polymeric isocyanate compounds including, e.g., toluene diisocyanate and isophorone diisocyanate, may also be used. The crosslink density of the composition is preferably from about 550 to about 680.

The polyurethane composition also includes a catalyst. Examples of useful catalysts include tertiary amines including, e.g., diazabicylo- and triazabicyclo-alkanes and alkenes including, e.g., 1,4-diazobicyco-2,2,-octane, 1,8-diazobicyclo-5,4,0-undec-7-ene, 1,5-diazobicyclo-4,3,0-non-5-ene, and 1,5,7-triazabicyclo-4,4,0-dec-5-ene, N-(3-dimethylamino) propyl-N,N',N'-trimethyl-1,3-propanediamine, acylic tertiary triamine N-(3-dimethylamino )propyl-N,N',N'-trimethyl-1,3-propanediamine and combinations thereof.

The composition can further include additives capable of lowering shrinkage, enhancing bonding to metallic substrates, or a combination thereof. Examples of useful additives include soft fillers such as calcined clay and mica, hard fillers such as glass fibers, wollastonite and ceramic fibers, hydrophobic silicas and glass beads. The composition can also include silane coupling agents including, e.g., glycidoxypropyltrimethoxysilane.

The method can be used to modify the channel of a variety of thermal barrier assemblies including, e.g., window casings, door casings and curtain walls. The method is also suitable for modifying channels made from a variety of materials including, e.g., metal (e.g., aluminum and steel) and polymer. The channel surface can be modified during the thermal barrier assembly manufacturing process.

Figure 2:
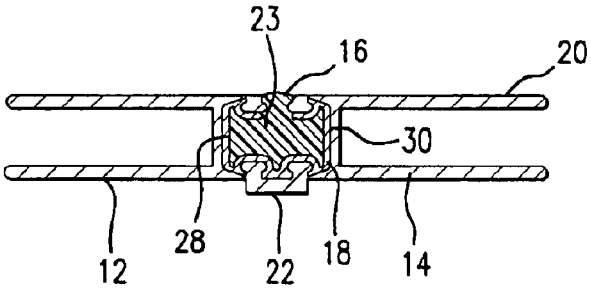
FIG. 2 is a sectional view of a metal thermal barrier assembly that includes a central channel, a thermal barrier composition and a bridge extending across one side of the channel.
Figure 3:
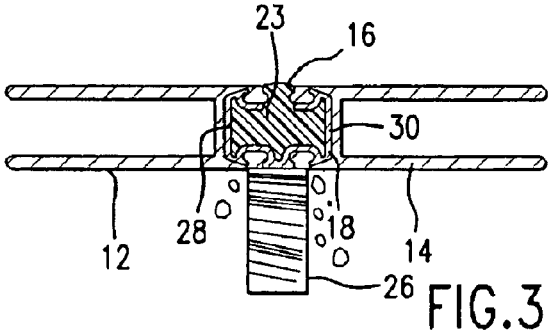
FIG. 3 is a sectional view of the channel of FIG. 2 in which the channel bridge is being removed to create the thermal barrier assembly of FIG. 1.

FIGS. 1–3 illustrate one embodiment of a thermal barrier assembly 10 that includes a thermal barrier composition 16 disposed in a surface-modified 18 channel 23 defined by two components 12, 14 that are bonded to each other through the thermal barrier composition 16. Initially the channel 23 is formed from a unitary extrusion 20 that includes an interior portion 12 (i.e., the portion of the thermal barrier that will be positioned towards the interior of a structure, e.g., a building) and an exterior portion 14 (i.e., the portion of the thermal barrier that will be positioned towards the exterior of a structure), which are connected by a bridge 22. Together the three portions of the extrusion 20 define the central channel 23 having side walls 28, 30. The channel 23 has been surface-modified to include a metal coating 18.

In FIG. 3, a mill 26 is shown removing bridge 22 so as to break the connection between the interior 12 and exterior portions 14 of unitary extrusion 20 and thereby form the thermal barrier assembly of FIG. 1.

The invention will now be described further by way of the following examples. All parts, ratios, percents and amounts stated in the Examples are by weight unless otherwise specified.

EXAMPLES

Test Procedures

Test procedures used in the examples include the following.

Thermal Cycling Method

A sample is cycled according to AAMA TIR-A8-90 section 5.1.4 entitled, "Thermal Cycling."

The sample channels are cut into 30 inch sections. The ends of the 30 inch sections are cut flat and the location of the barrier composition within the channel is measured with a micrometer to determine the position of the barrier composition within the channel. The length of the barrier composition, the channel length and finish are then recorded.

The samples are then cycled from −40 to +160 degrees Fahrenheit as follows:

The sample is heated to 70° F. for 5 minutes, −40° F. for 1 hour and 5 minutes, 0° F. for one hour, 160° F. for 1 hour and 5 minutes, 130° F. for 1 hour and 70° F. for 5 minutes throughout the cycling the environment is maintained at 50% relative humidity. The cycle is repeated 30 times. The sample was then removed and conditioned at 73° F., 50% relative humidity for 24 hours at which time measurements can be taken.

The cycling is then repeated for a total of 90 cycles.

% Shrinkage Test Method

A sample is prepared and the initial length of barrier composition in the channel is measured. The sample is then cycled for a total of 90 cycles according to the Thermal Cycling Method. After cycling is complete, the final length of the barrier composition in the channel is measured. The percentage of shrinkage is determined based on the initial and final barrier composition length measurements.

Shear Test Method

Shear is determined according to ASTM Standard Practice E575-83.

The dimensions of a treated channel are measured and recorded. A treated channel is then filled with an adhesive thermal barrier composition prepared as described above. The adhesive thermal barrier composition is cured and then the channels are debridged, i.e., the process whereby the aluminum bridge connecting the exterior and interior portions of the extruded thermal break cavity is removed, e.g., by milling or sawing (see AAMA TIR-A8-90 Thermal Break Manual, page 9. section 4.2.4 entitled, "Cure Time and Debridging"). The debridged channels are then cut into 4 inch sections for initial shear testing and 30 inch sections for shear testing after 90 cycles.

The shear test specimen is locked into position in a vice of an Instron 55R4507 universal shear testing machine (Instron, Inc., Canton, Mass.) that is capable of exerting a force of up to 10000 pounds. The inside wall of the thermal barrier channel is held rigid while force is applied to the outside wall at a crosshead speed of 0.2 inches per minute using load cell no. 95 having a 45,000 lb as described in AAMA TIR-A8-90 Manual, page 24, section 7.3 entitled, "Tensile, Eccentric Load and Shear Tests."

Testing continues until failure, i.e., either the adhesive composition is sheared from the metal channel or the metal deforms. The value displayed on the Instron is recorded in $lb/in^2$.

The samples are tested initially and after being subjected to 90 cycles according to the Thermal Cycling Method.

Coating Thickness

The thickness of the channel is measured before treatment and after treatment using a micrometer. The difference between the measurements is recorded as the thickness of the deposited coating.

Coating Strength

The strength of the deposited coating is determined by scratching the metal deposit with the working end of a screwdriver. If the screwdriver does not debond the coating from the surface, the sample is recorded as "pass." If the screwdriver can easily remove the coating, the sample is recorded as "fail."

The plasma was generated under the following conditions: air pressure 10–90 psi, applied voltage 20–35 VAC and an applied current of 50–220 amps for channels having an anodized finish.

Controls

The controls were untreated thermal barrier "C" channel as defined by AAMA TIR-A8-90 Thermal Break Manual, section 4.1.1 entitled, "Cavity Design," and having the coating specified in Table 1.

The percent coverage of the metal coating deposited on the channel surface of each of the Examples was visually observed and recorded as "% Coverage" in Table 1.

The channels were tested according to the % Shrinkage, Shear, Coating Thickness and Coating Strength test methods.

Examples 1–6 passed the Coating Strength test. The % shrinkage, shear and coating thickness results are reported in Table 1.

TABLE 1

| Sample | Finish | % Coverage | Coating Thickness (in) | Line Speed (ft/min) | % Shrinkage | Initial Shear Strength (psi) | Shear Strength after 90 cycles (psi) |
|---|---|---|---|---|---|---|---|
| Control 1 | U | 0 | NA | NA | 12.10 | 9626 | 2253 |
| Control 2 | U | 0 | NA | NA | 2.61 | 11335 | 2484 |
| Example 1 | U | 10 | 0.0030 | 88 | 0.00 | NT | 13918 |
| Example 2 | U | 10 | 0.0120 | 53 | 0.00 | 13580 | 5618 |
| Example 3 | U | 10 | 0.0245 | 40 | 0.00 | 13226 | 12054 |
| Control 1 | CL | 0 | NA | NA | 20.44 | 14197 | 2253 |
| Control 2 | CL | 0 | NA | NA | 10.10 | 15240 | 4646 |
| Example 4 | CL | 10 | 0.0090 | 88 | 2.10 | 16387 | 19143 |
| Example 5 | CL | 10 | 0.0075 | 53 | 4.70 | 14137 | 21045 |
| Example 6 | CL | 10 | 0.0110 | 40 | 2.94 | 17404 | 25918 |

U = bronze anodized finish
CL = clear anodized finish
NA = not applicable
NT = not tested

Examples

Sample Preparation

A "C" channel as defined by AAMA TIR-A8-90 Thermal Break Manual, section 4.1.1 entitled, "Cavity Design," and having the finish specified in Table 1 was exposed to the plasma of an electric arc gun mounted on a fill-carrier, which is a unit with one side established with a drive system powered either by variable speed hydraulic or electric motors. The arc gun was mounted so as to be capable of moving in the X, Y, and Z directions and tilting. Idler wheels were used to move the channel to the desired position and locking the channel in position for treatment. The gun was mounted between two drive stations. The first drive station fed the channel into the hood and the other drive station pulled the channel out of the hood. Both drive units, called "fill-carriers," were calibrated to drive at the same rate of speed.

The arc gun was fitted with a fine air cap having a narrow orifice such that when the gun was turned on the plasma emanated from the orifice in a spray that was approximately ¼-inch wide at the point of origin. The arc gun was positioned such that the orifice was directed downward toward the channel surface at a point from about 1 to 2 inch from the channel surface. The channel temperature increased during the plasma treatment process. Temperatures were approximately 150° F.

Other embodiments are within the claims.

What is claimed is:

1. A method of modifying a thermal barrier assembly comprising a channel, said method comprising:

exposing a surface of said channel to a plasma comprising metal moieties; and depositing said metal moieties on the surface of said channel, wherein said thermal barrier assembly comprises at least a portion of a casing.

2. The method of claim 1, wherein said channel comprises a surface treatment prior to said depositing step, said method further comprising removing at least a portion of said surface treatment from said channel.

3. The method of claim 1, wherein said metal is selected from the group consisting of aluminum, nickel, chromium, iron, graphite, molybdenum, copper, cobalt, tungsten, indium, manganese, zirconium, zinc, cesium, yttrium, antimony, and oxides, carbides, nitrides and suicides thereof, and alloys and mixtures thereof.

4. The method of claim 1, wherein said thermal barrier assembly comprises at least a portion of a casing selected from the group consisting of a window casing, door casing and curtain wall casing.

5. The method of claim 1, wherein said depositing comprises forming a metal coating on the surface of said channel.

6. The method of claim 1, wherein said coating has a thickness of no greater than about 2 mm.

7. The method of claim 1, wherein said channel is defined by a substrate comprising metal.

8. The method of claim 7, wherein said metal is aluminum.

9. The method of claim 1, wherein said channel is defined by a substrate comprising a polymer.

10. The method of claim 1, wherein said channel comprises a first side wall, a second side wall positioned parallel to said first side wall and spaced no greater than about 2.5 cm from said first side wall.

11. The method of claim 1, wherein said thermal barrier assembly comprises a window casing.

12. The method of claim 1, wherein said thermal barrier assembly comprises a door casing.

13. The method of claim 1, wherein sad thermal barrier assembly comprises a unitary structure.

14. The method of claim 1, wherein said channel comprises a surface treatment disposed on said channel prior to exposing said channel surface to said plasma.

15. A thermal barrier assembly comprising:

a channel comprising a layer of metal bonded to a surface of said channel, said metal having been deposited on said channel surface from a plasma to form a modified surface, wherein said thermal barrier assembly comprises at least a portion of a casing.

16. The thermal barrier assembly of claim 15, further comprising an adhesive composition bonded to the modified surface of said channel.

17. The thermal barrier assembly of claim 16, wherein said adhesive composition comprises polyurethane.

18. The thermal barrier assembly of claim 16, wherein said adhesive composition exhibits no greater than 5% shrinkage when bonded to said surface and subjected to the % Shrinkage Test Method.

19. The thermal barrier assembly of claim 16, wherein said adhesive composition exhibits no greater than 1% shrinkage when bonded to said surface and subjected to the % Shrinkage Test Method 20. The thermal barrier assembly of claim 16, wherein said adhesive composition exhibits a shear strength of at least 2500 psi shear strength at room temperature after being subjected to the Thermal Cycling Method.

21. The thermal barrier assembly of claim 16, wherein said adhesive composition exhibits a shear strength of at least 3000 psi at room temperature after being subjected to the Thermal Cycling Method.

22. The thermal barrier assembly of claim 16, wherein said adhesive composition exhibits a shear strength of at least 7500 psi at room temperature after being subjected to the Thermal Cycling Method.

23. The thermal barrier assembly of claim 15, wherein said metal is selected from the group consisting of aluminum, nickel, chrorniunm, iron, graphite, molybdenum, copper, cobalt, tungsten, indium, manganese, zirconium, zinc, cesium, yttrium, antimony, and oxides, carbides, nitrides and silicides thereof, and alloys and mixtures thereof.

24. The thermal barrier assembly of claim 15, wherein said channel is defined by a substrate comprising metal.

25. The thermal barrier assembly of claim 24, wherein said metal comprises aluminum.

26. The thermal barrier assembly of claim 15, wherein said channel is defined by a substrate comprising a polymer.

27. A casing comprising the thermal barrier assembly of claim 15.

28. A process for making a thermal barrier assembly, said process comprising:

exposing a surface of a channel of a thermal barrier assembly to a plasma comprising metal moieties; and depositing said metal moieties on the surface of said channel, wherein said thermal barrier assembly comprises at least a portion of a casing.

29. The process of claim 28, further comprising contacting the metal surface of said channel with an adhesive composition.

30. The process of claim 28, wherein prior to said depositing, said channel comprises a surface treatment disposed on the channel surface, said process further comprising removing at least a portion of said surface treatment prior to depositing said metal moieties.

31. The process of claim 28, wherein said metal is selected from the group consisting of aluminum, nickel, chromium, iron, graphite, molybdenum, copper, cobalt, tungsten, indium, manganese, zircouium, zinc, cesium, yttrium, antimony, and oxides, carbides, nitrides and silicides thereof, and alloys and mixtures thereof.

32. The process of claim 29, wherein said adhesive composition comprises polyurethane.

33. The process of claim 28, wherein said surface treatment is selected from the group consisting of polyester, melamine, mill finish, conversion coating, primer, paint, acrylic, polyester, enamel, polyurethane, fluoropolymer, anodic finishes and combinations thereof.

34. The process of claim 28, wherein said channel is defined by a substrate comprising metal.

35. The process of claim 34, wherein said metal comprises aluminum.

36. The process of claim 28, wherein said channel is defined by a substrate comprising a polymer.

37. A process for making a window casing comprising the process of claim 28.

38. A process for making a door casing comprising the process of claim 28.

39. A thermal barrier assembly comprising:

a channel comprising a layer of metal bonded to a surface of said channel, said metal having been deposited onto said channel surface from a plasma to form a modified surface; and an adhesive composition bonded to the modified surface of said channel, said adhesive composition comprising polyurethane.

40. A window casing comprising the thermal barrier assembly of claim 39.

41. A door casing comprising the thermal barrier assembly of claim 39.

42. A process for making a thermal barrier assembly, said process comprising:

providing a thermal barrier assembly comprising a channel, and a surface treatment disposed on a surface of said channel;

exposing said treated surface of said channel to a plasma comprising metal moieties;

removing at least a portion of said surface treatment; and depositing said metal moieties on the surface of said channel.

43. The process of claim 42, wherein said surface treatment is selected from the group consisting of polyester, melamine, mill finish, conversion coating, primer, paint, acrylic, polyester, enamel, polyurethane, fluoropolymer, anodic finishes and combinations thereof.

44. A process for making a thermal barrier assembly, said process comprising:

exposing a surface of a channel of a thermal barrier assembly to a plasma comprising metal moieties;

depositing said metal moieties on the surface of said channel; and contacting the metal surface of said channel with an adhesive composition comprising polyurethane.

45. A window casing, door casing, or curtain wall casing comprising a thermal barrier comprising:

a thermal barrier assembly comprising a channel comprising a modified surface; and a layer of metal bonded to a surface of said channel, said metal layer having been deposited onto said channel surface from a plasma; and an adhesive composition bonded to the modified surface of said channel.

46. A thermal barrier assembly comprising:

a first structure component;

a second structural component;

a channel disposed between said first structural component and said second structural component.

a layer of metal bonded to a surface of said channel, said metal having been deposited on said channel surface from a plasma; and an adhesive composition disposed in said channel, said first structural component being bonded to said second structural component through said adhesive composition.

47. A thermal barrier assembly comprising:

a metal substrate defining a U-shaped channel having an interior surface, the interior surface of said U-shaped channel having been modified by the deposition of metal onto said channel surface from a plasma; and an adhesive composition bonded to said interior surface of said channel.

* * * * *

UNITED STATES PATENT AND TRADEMARK OFFICE

CERTIFICATE OF CORRECTION

PATENT NO. : 6,962,025 B1
DATED : November 8, 2005
INVENTOR(S) : Nathanael Hill

It is certified that error appears in the above-identified patent and that said Letters Patent is hereby corrected as shown below:

Column 8,
Line 59, after “nitrides and,” delete “suicides” and insert -- silicides --.

Column 9,
Line 54, after “nickel,” delete “chrorniunm” and insert -- chromium --.

Column 10,
Line 16, after “manganese,” delete “zircouium” and insert -- zirconium --.

Column 11,
Line 13, delete “structure” and insert -- structural --.
Line 16, after “component” delete “.” and insert -- , --.

Signed and Sealed this

Second Day of May, 2006

JON W. DUDAS
*Director of the United States Patent and Trademark Office*